United States Patent [19]

MacGregor

[11] 4,231,711

[45] Nov. 4, 1980

[54] EXTRACT OF ENERGY FROM THE SEA

[76] Inventor: Daniel MacGregor, MacGregor Industries Limited, Canal Estate,, Langley, Buckinghamshire, SL3 6EQ, England

[21] Appl. No.: 940,668

[22] Filed: Sep. 8, 1978

[51] Int. Cl.[3] ..... F04F 11/00

[52] U.S. Cl. ..... 417/100; 60/499

[58] Field of Search ..... 417/6, 100, 94, 331, 417/226, 227, 12; 60/495, 496, 499, 501, 502

[56] References Cited

U.S. PATENT DOCUMENTS

| | | | |
|---|---|---|---|
| 595,919 | 12/1897 | Phillips | 417/226 |
| 1,430,868 | 10/1922 | Weyrick | 417/226 |
| 3,149,776 | 9/1964 | Parrish | 417/100 |
| 3,970,415 | 7/1976 | Widecrantz et al. | 60/496 X |
| 4,022,549 | 5/1977 | Gregg | 417/100 |
| 4,108,579 | 8/1978 | Martinez et al. | 60/496 X |
| 4,139,984 | 2/1979 | Moody et al. | 417/100 X |

*Primary Examiner*—Richard E. Gluck

*Attorney, Agent, or Firm*—Watson, Cole, Grindle & Watson

[57] ABSTRACT

The invention provides apparatus for extracting energy from waves in the surface of a body of water, comprising a structure adapted to float on the water and having an inlet channel and means for anchoring the structure with the inlet channel facing into incoming waves; and means for converting the energy contained in water entering the inlet channel as a result of the wave motion, to a transmittable form.

10 Claims, 5 Drawing Figures

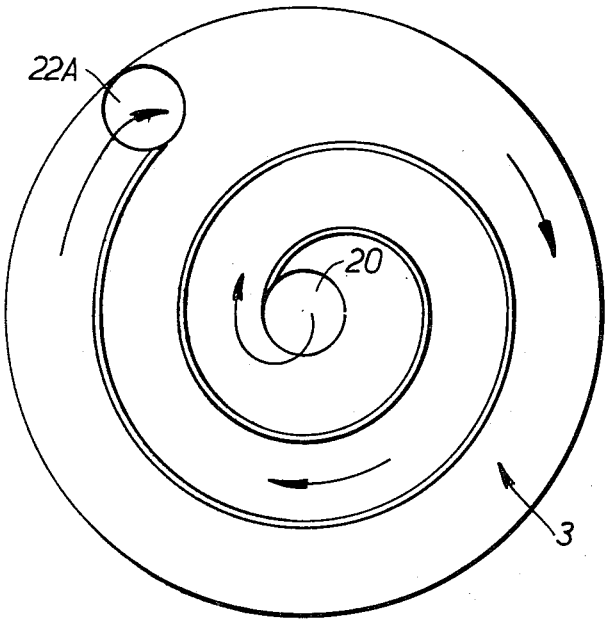
FIG. 5.
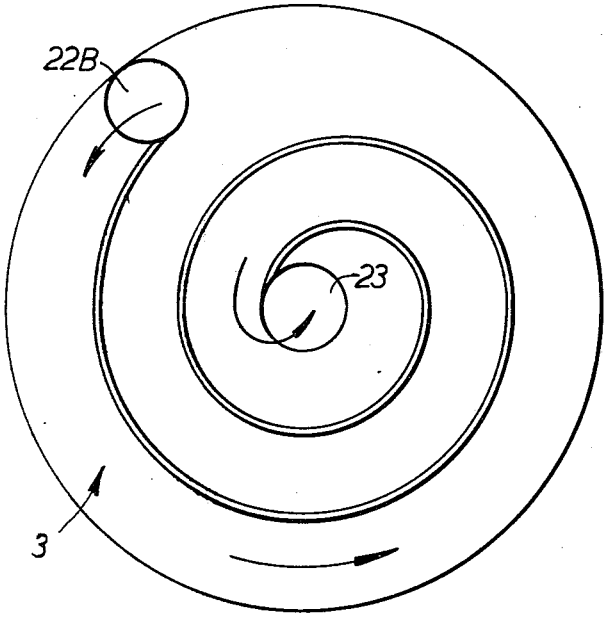

EXTRACT OF ENERGY FROM THE SEA

BACKGROUND OF THE INVENTION

This invention relates to the extraction of energy from the sea, and particularly from that part of the sea which is adjacent to the sea shore.

It is known that the movement of water particles constitutes a greater totality of power in the open sea than near the shore, but, in selected positions, where a gently shelving beach, composed of low friction material, faces an unrestricted ocean, the energy is concentrated into what is known as surf. This concentration comes from the forward motion of the water particles being directed into the equivalent of a converging channel in the horizontal plane, with the sloping beach working against gravity.

SUMMARY OF THE INVENTION

According to the present invention, there is provided apparatus for extracting energy from waves in the surface of a body of water, comprising a structure adapted to float on the water and having an inlet channel and means of anchoring the structure with the inlet channel facing the oncoming waves; and means for converting the energy contained in the water entering the inlet channel as a result of the wave motion to a transmittable form.

The energy conversion means carried by the floating structure may take various forms. The preferred form comprises at least one air chamber arranged for the compression of the air contained therein by successive waves entering the water inlet and an outlet duct for compressed air leading from the chamber. As waves enter the water inlet, they will cause air in the chamber to be expelled through the duct. Such expelled air may be used in various ways, but the preferred method is to lead it through a flexible pipe to an air reservoir on the sea bed, thence to a low pressure turbine and electricity generator on shore.

A number of such apparatuses may be combined in a group, so the outlet ducts lead to a common reservoir and, by placing the individual apparatuses at different distances from the shore, a more regular supply of compressed air is assured.

Preferably all forms of the apparatus are provided with means for accommodating different wave forces to avoid damage during storm. As the apparatus must be anchored by a link, such as a chain or cable, which extends seawards from the apparatus and is substantially greater in length than the depth of water in which the apparatus has to float, increasing wave force on the apparatus will cause it to travel in an arc of a circle in a vertical plane about the anchor point as a centre and be depressed deeper and deeper in the water.

In addition the apparatus may have at least one pressure responsive valve arranged to open a passage through the apparatus to an exhaust outlet so that, when the pressure becomes intense, water is able to flow through the apparatus more freely, and a smaller proportion of the greater energy available is imparted to the means of converting energy. Another way by which the level of flotation can be varied is to provide a valve or valves in the flotation chambers to admit water when the outside pressure is greater than a predetermined amount. These various means will be co-ordinated so that in a severe storm, the pressure to which the apparatus is held to a minimum to enable it to survive, while continuing to produce the normal amount of power.

BRIEF DESCRIPTION OF THE DRAWINGS

The invention may be carried into practice in various ways, but some embodiments will now be described by way of example, with reference to the accompanying diagrammatic drawings in which:

FIG. 5 is a plan view of part of the air chamber shown in FIG. 1.

DESCRIPTION OF A PREFERRED EMBODIMENT

Figure 1:
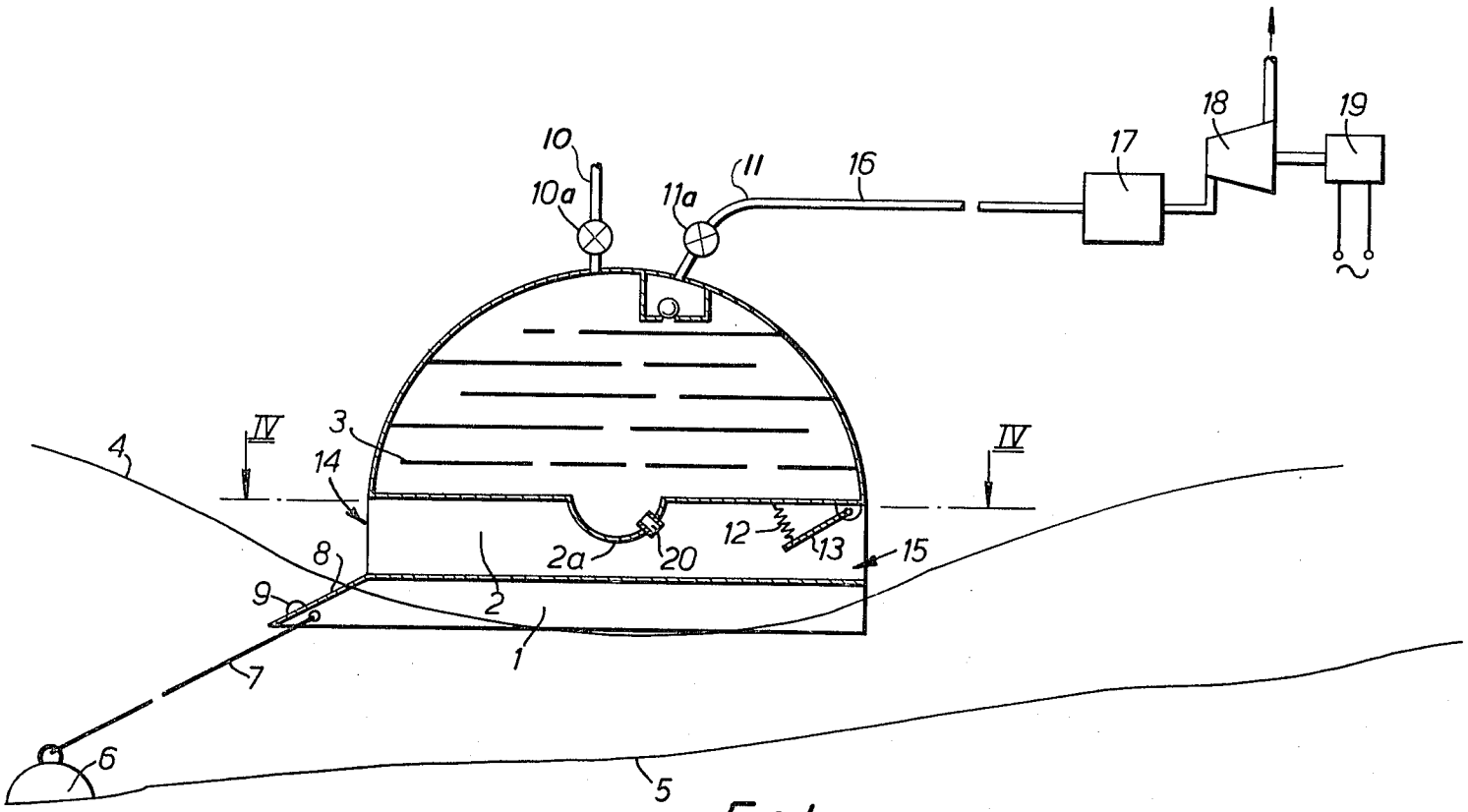
FIG. 1 is an elevation in schematic cross section of a simple embodiment of the invention.

FIG. 1 shows a body composed of three parts: 1 twin hulls, 2 water channel and 3 air chamber, arranged to float on the surface of the sea, just off-shore of the breaking wave, above a shelving beach, a typical wave being 25 shown 4. The body is moored by means of an anchor chair or rope 7 to a ground anchor. The length of the chain 7 is great in relation to the mean depth of the sea beneath the body, so that as the body rises and falls with the waves it follows an arc round the anchor 6.

The body has formed therein a water channel 2, with an open mouth 14 directed, when the body is moored, to face the incoming waves. The channel 2 runs to the back of the body. A valve means which can be flap or other suitable type valve, but which is shown for simplicity as flap valve 13, is pivotally mounted in the channel 2 and held in the open position by the spring 12, but in its other position will close the water outlet 15.

The buoyancy hulls 1 are at the side of the water channel 2 and also are deeper in the water than the channel 2, the mouth of which is intended to skim over the top of the water in dead calm. They are joined at the front by an upwardly inclined plate 8 to further concentrate the flow.

The air chamber 3 is preferably divided into a series of spiral passages to form a long passage extending from the entrance 20 to the air chamber to the exit 11 which is provided with a combined nonreturn valve and ball valve 11*a*. These lead to a flexible outlet pipe 16. The top of the air chamber also has an air inlet 10, with an associated non return valve 10*a*.

The air outlet 11 and the flexible pipe 16 lead as shown schematically to a pipe/reservoir 17 and thence to a low pressure turbine 18, with electrical generator 19. The turbine and generator may be mounted on the body, but are preferably positioned on shore.

It is desirable that the flap valve 13 is hinged at the top of the channel so as to induce a free flow in the channel before the valve takes effect. In the diagram, an ordinary spring is shown, but it is preferable, in view of the deleterious effect of salt water, that the spring should take the form of a wheel or wheels running on a rail or guide. Inside the wheel or wheels would be a spring or springs, insulated from the fluid, and arranged to drive the wheels so as to urge the valve to the open position.

Attention is drawn to the shape of the roof of the water channel, where a downward protuberance 2a is provided, and where the passage is on that part of the roof protuberance facing the water exit. This shape creates a venturi effect, to assist water evacuation from the air chamber.

Various details and modifications of the embodiment are shown in FIGS. 2, 3, 4 and 5.

The air chamber 3 may be formed in sections which are mounted on top of each other. Each section includes a spiral passage as best seen in FIG. 5. The spiral passage in the first section commences at the centre with the entrance 20 and ends with an outlet 22A at the periphery to connect with an inlet 22B to the passage in the next section which spirals in again into an outlet to connect with the next section and so on. In this way a continuous passage commences at 20 and ends at 11. The sketch of passages in FIG. 5 is very much simplified, as there are many more turns of the spirals than are shown.

Figure 2:
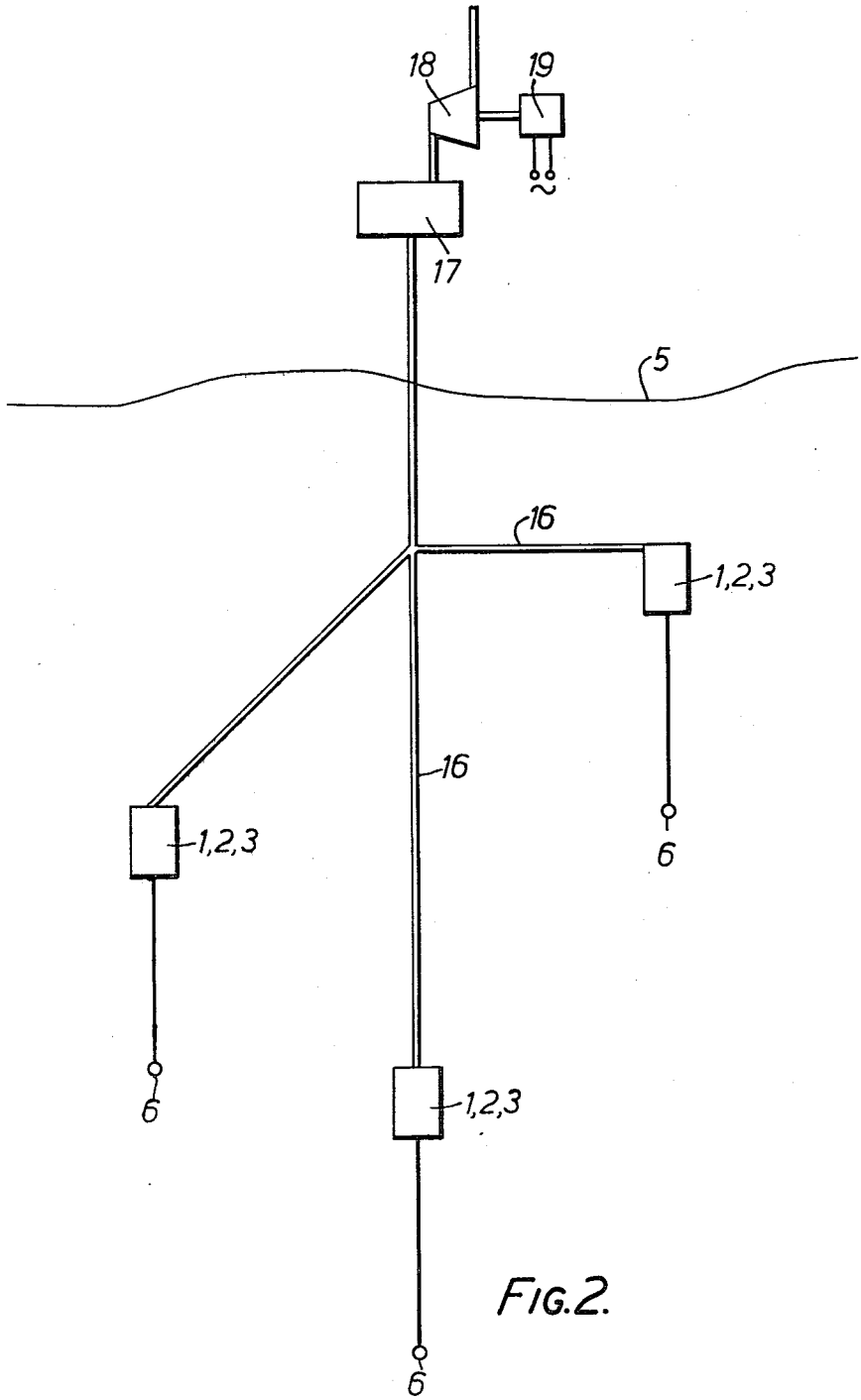
FIG. 2 is a schematic plan view of an assembly of three units.
Figure 3:
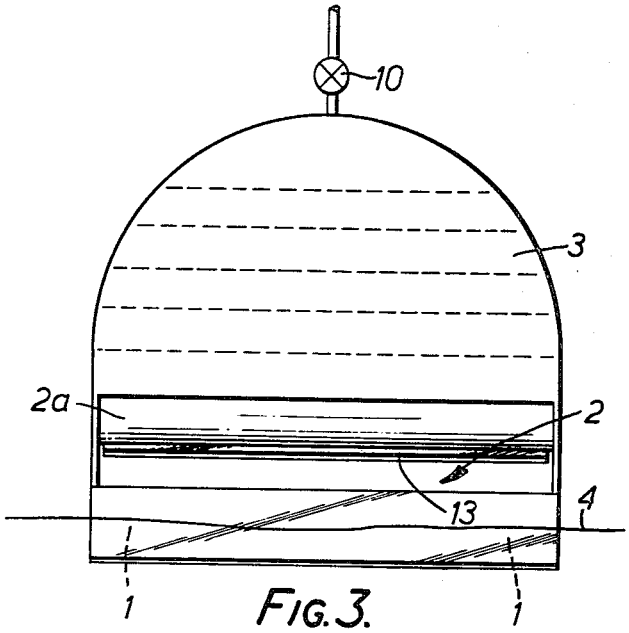
FIG. 3 is a front view of the apparatus.
Figure 4:
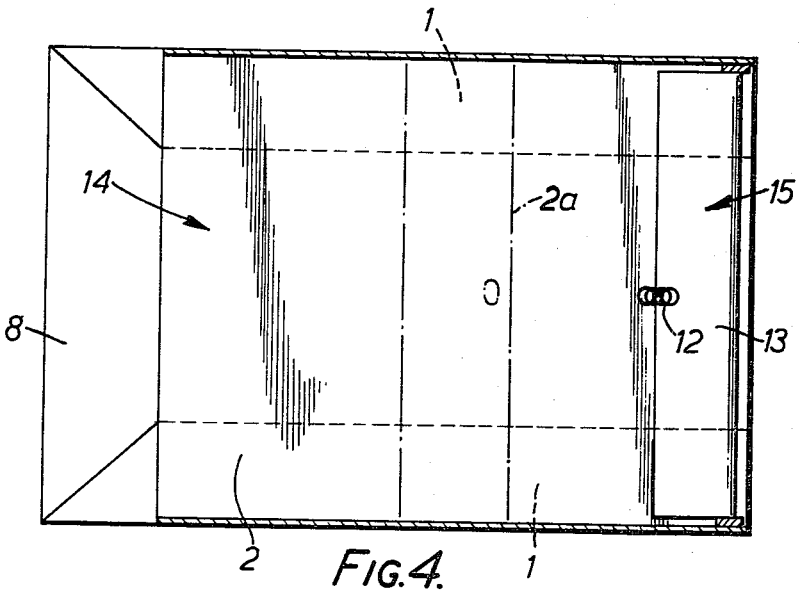
FIG. 4 is a plan view of the water channel, with supporting hulls, shown in schematic section on the line IV—IV in FIG. 1.

FIG. 2 shows schematically in plan view, how three units may be used together. The arrangement is spaced according to the normal wave period so that each unit experiences the incoming wave pattern in a timed sequence.

In operation, an incoming wave causes a mass of water to flow into the channel 2. The impact of the water on the flap valve 13, causes it to pivot and close the outlet 15. The momentum of the water causes it to rush through the entrance 20, compressing the air and causing it to open the valve 11 and flow under pressure into the reservoir 17. The ball or float valve incorporated in 11 prevents water following the air.

The weight of the water in the body and the pull on the anchor chain cause the body to sink in the sea. This brings into action the buoyancy hulls and especially those parts which normally are above sea level and the body is forced rapidly up again. As soon as pressure equalises inside the channel 2, the spring 12 pulls the flap valve 13 to open the water outlet 15.

As the rise coincides with the weakening of the surf wave, water flows out of the body and the valve 10 opens to admit air to the air chamber 3. Thus the process is repeated when the next wave comes along.

The compressed air drives the turbine to produce useful work.

Since the apparatus is intended to be moored on a shelving beach in the region in which surf is encountered, it will be subject to severe conditions. Means are accordingly provided for ameliorating the impact of the wave during a storm. Thus, as the pressure exerted by the incoming wave on the apparatus increases abnormally, the apparatus will tend to float lower in the sea, as it moves in an arc in a vertical plane about the point of anchorage of the cable 7 as centre. The lower the apparatus sinks the less impact the waves will have on it.

Secondly means may be provided to reduce the resistance to flow through the channel 2. Thus the channel 2 may contain an outlet valve, not shown, preferably in the form of a flexible annular diaphragm which normally is closed but which, in face of increasing pressure in the channel, may distend to allow water to escape.

Thirdly, pressure responsive valves 9 may be provided in the front end of the hulls, these valves being arranged to open when the impact of the waves becomes too severe. Sea water will then be admitted and the apparatus will then sink. It would then become inoperative, but this would only happen in abnormal circumstances and would be preferred to destruction in the waves.

It will be appreciated that the use of the above embodiment is not restricted but, with some modifications, it may be used in a river.

What I claim as my invention and desired to secure by Letters Patent is:

1. Apparatus for extracting energy from waves in the surface of a body of water, comprising a structure moored in and floating in the body of water and having an inlet channel disposed to face into oncoming waves; and means for converting the energy contained in water entering the inlet channel as a result of the wave motion, to a transmittable form, said means comprising an air chamber in the form of an elongate spiral passage having a passage at one end, in communication with a downstream part of the inlet channel and having an air inlet and outlet at the other end, a rear outlet from the downstream part of the inlet channel, and valve means operable, in response to water flowing into the channel, to close suddenly the rear outlet and cause that water flowing into the channel to enter the chamber and pressurize air in the chamber whereby to enable the pressurized air to be taken from the air outlet from the chamber to do useful work.

2. Apparatus as claimed in claim 1, including a one way outlet valve in the outlet for the supply of pressurised air from the air chamber.

3. Apparatus as claimed in claim 1, including a float valve operative on the outlet for the supply of pressurized air from the air chamber, to prevent water following the air.

4. Apparatus as claimed in claim 1, including a low pressure air turbine mechanism in communication with the air chamber.

5. Apparatus as claimed in claim 1, including a one way inlet valve arranged to allow air into the chamber.

6. Apparatus as claimed in claim 1, in which the valve means comprises a flap valve pivotally mounted at the outlet end of the water channel, for movement between a closed position to close the rear water outlet and an open position to open the rear outlet.

7. Apparatus as claimed in claim 1, in which the valve means is resiliently biased in the open position.

8. Apparatus as claimed in claim 1, anchored offshore in which the structure is anchored by means of an attachment point on the bottom of the structure towards the front and adjacent the inlet to the inlet channel, an anchor chain attached to the anchor point at one end and at the other end to a ground anchor positioned offshore relative to the apparatus so as to moor the apparatus immediately off-shore of the breaking waves.

9. An assembly of a plurality of apparatuses as claimed in claim 8 moored off-shore at different distances from the shore so as to experience incoming waves as a sequence, the means for converting energy of the apparatuses being coupled together.

10. Apparatus as claimed in claim 1 in which the inlet channel has a constriction, and said chamber communicates with the channel downstream of the constriction.

* * * * *